United States Patent [19]

Sarrafian et al.

[11] 4,324,403

[45] Apr. 13, 1982

[54] POST ASSEMBLY FOR PINBALL GAME

[75] Inventors: Vahram K. Sarrafian, Glenview; Syng N. Kim, Hoffman Estates, both of Ill.

[73] Assignee: Max Wiczer, Skokie, Ill.

[21] Appl. No.: 180,633

[22] Filed: Aug. 25, 1980

[51] Int. Cl.[3] ..... A63B 71/00

[52] U.S. Cl. ..... 273/127 R; 273/129 P; 24/216; 411/57

[58] Field of Search ..... 273/127 R, 121 A; 411/57; 24/107, 201 LP, 208 A, 213 B, 213 CS, 214, 216, 217 R

[56] References Cited

U.S. PATENT DOCUMENTS

| | | | |
|---|---|---|---|
| 1,830,460 | 11/1931 | Berge | 24/214 |
| 2,937,834 | 5/1960 | Orenick et al. | 24/216 |
| 3,200,694 | 8/1965 | Rapata | 24/214 |
| 4,168,067 | 9/1979 | Wiczer | 273/127 R |

*Primary Examiner*—Richard C. Pinkham
*Assistant Examiner*—T. Brown
*Attorney, Agent, or Firm*—Dithmar, Stotland, Stratman & Levy

[57] ABSTRACT

The post assembly comprises a one-piece post which includes a body portion with a plurality of legs protruding in one direction and having an axial bore therethrough. The legs are adapted to be forced toward one another so that they can be inserted into the opening of a playfield board of a pinball game. The assembly also includes a plug insertable in the bore from the top and then into the space between the legs to force them outwardly for embedding lateral teeth on the legs into the wall of the opening in the playfield board to hold the post in place. A lug at the top of the plug extends above the post and passes through a hole in a coverr plate and has fastening structure to accommodate a push-type fastener.

8 Claims, 5 Drawing Figures

POST ASSEMBLY FOR PINBALL GAME

BACKGROUND OF THE INVENTION

The pinball game has a playfield board and a number of pinballs propelled usually one after another onto the board. Located on the board are various kinds of ball objectives and targets which, when struck, register a score. One of these objectives or targets may be a rubber ring or band encircling a set of posts. A switch (or switches) has its blade protruding through an opening in the playfield board and in contact with the rubber band. When the ball strikes the band, the switch is actuated, causing a score to be registered. Also, a kicker device may be associated with the rubber band causing the ball to be rebounded at an increased speed. Usually, a decorative plastic plate is carried by these posts which may be illuminated when the score is registered.

Copending application Ser. No. 959,714, filed Nov. 13, 1978 for POST ASSEMBLY FOR PINBALL GAME discloses a post assembly for a pinball game. The post disclosed in that application has a plurality of outwardly biased legs which could be moved toward one another so that they could be inserted in the opening of the playfield board. A plug is then insertable between the legs from beneath the playfield board for forcing the legs outwardly into frictional engagement with the wall of the opening. While this arrangement provided a tight attachment to the playfield board, it necessitated access to the underside of the playfield board to permit insertion of the plug to complete the assembly.

In this prior arrangement, a lug at the top of the post was fitted through a hole in the associated decorative plastic plate for receiving a push-type fastener, but no means was provided for positive attachment of the lug to the fastener.

SUMMARY OF THE INVENTION

It is, therefore, an important object of the present invention to provide a post for use in a pinball game which is tightly held in the playfield board of the pinball game and which provides for tight attachment to the associated cover plate, but which can be fully assembled from above the playfield board without access to the underside thereof.

In summary, there is provided a post assembly for use in a pinball game having a playfield board for supporting a rolling pinball, the post assembly being adapted to support a cover plate having at least one hole therein and to be attached thereto with a fastener, the playfield board having at least one opening therein defined by a wall, the assembly comprising a post which includes an elongated body portion and a plurality of legs on one end of the body portion, the body portion having a longitudinal axis and having a cylindrical bore extending axially therethrough, the legs extending generally parallel to the longitudinal axis and being movable toward the axis to enable insertion into the opening of the playfield board, and a plug having a relatively long cylindrical shank and an enlarged tip at one end of the shank and a lug at the other end of the shank, the enlarged tip being dimensioned to be received through the bore to a mounting position in engagement with the legs for forcing the legs outwardly into engagement with the wall of the opening, the lug extending beyond the other end of the post generally parallel to the longitudinal axis when the enlarged tip is in the mounting position thereof and having a diameter to enable insertion through the hole in the cover plate.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation and many of its advantages should be readily understood and appreciated.

DESCRIPTION OF THE PREFERRED EMBODIMENT

Figure 1:
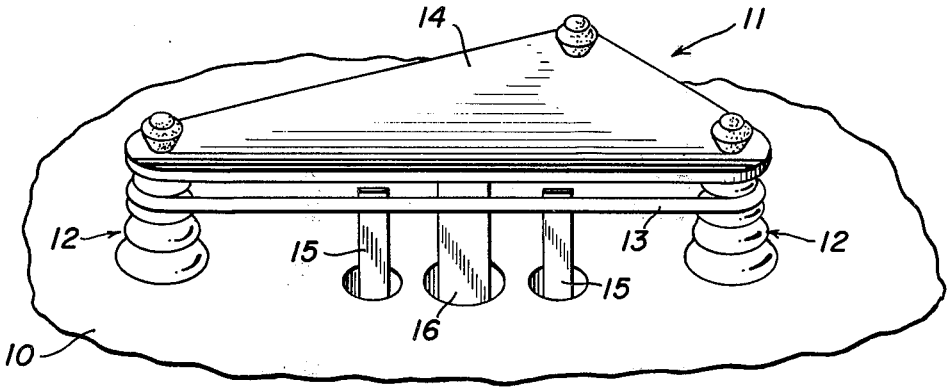
FIG. 1 is a perspective view of a slingshot apparatus on a fragmentary portion of a playfield board in a pinball game, such apparatus including three post assemblies incorporating the features of the present invention.
Figure 2:
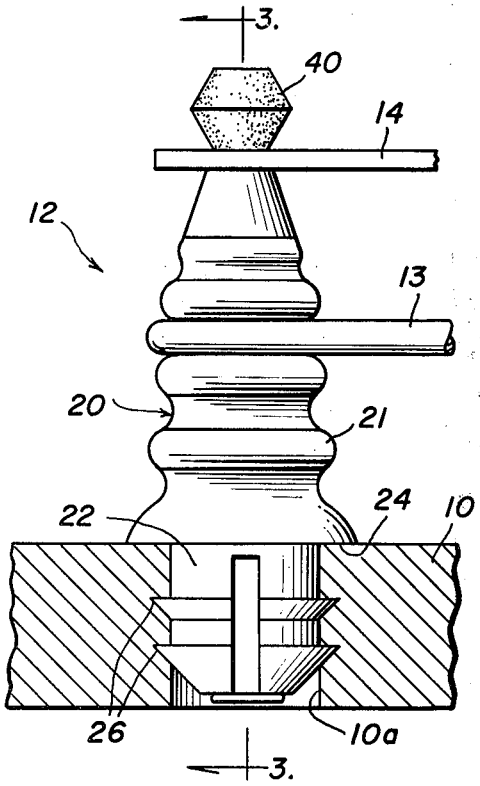
FIG. 2 is an enlarged view in elevation of a post assembly mounted to the playfield board and carrying a rubber band and a cover plate.

Referring to FIG. 1 of the drawings, there is shown a playfield board 10 of a pinball game. Carried on the playfield board 10 are a number of targets which, when struck by a pinball, will register a score. One of these targets is depicted in FIG. 1 and may be characterized as a slingshot apparatus 11. It comprises a set of three post assemblies 12, only two of which are shown. Each post assembly is mounted in an opening 10*a* (FIGS. 2–4) in the playfield board 10. Wrapped around the post assemblies 12 is an endless rubber ring or band 13 which usually is circular in cross section. The post assemblies 12 carry a cover plate 14 which may be formed of plastic and is usually imprinted with decoration. The plate 14 is preferably at least semi-transparent so that a lamp (not shown) beneath it, when illuminated, will enhance the decoration imprinted on the cover plate. The plate 14 has a plurality of holes 14*a* (FIG. 3) therethrough.

The particular apparatus 11 illustrated in FIG. 1 has associated therewith a pair of switches respectively with switch blades 15 protruding through the playfield board 10, the switches themselves being mounted beneath the board. The blades 15 are in contact with the rubber band 13 so that when a pinball strikes the band, the blades 15 are caused to shift, actuating the switch, which in turn causes a score to be registered. The switches associated with the blades 15 cause actuation of a solenoid (not shown) also beneath the playfield board 10 which pivots an arm 16 forcefully into the rubber band 13, causing the pinball to be rebounded at increased speed.

A pinball game may have one or more apparatuses 11 like that shown in FIG. 1. In addition, other apparatuses may incorporate two or more of the post assemblies 12, a rubber band 13, a plate 14 (perhaps of different shape), and one or more switches; it may or may not have an arm 16. Also, each apparatus may include a lamp beneath the cover plate 14 for illumination thereof when the apparatus is impinged by the pinball.

Referring now to FIGS. 2 through 5, details of each of the post assemblies 12 will be described. The post assembly 12 includes a post 20 having an elongated body portion 21 provided at one end thereof with a set of four legs 22. The inside surface 22*a* of each leg 22 may be flared outwardly and is arcuate. The outer end of each leg 22 is beveled to provide a frustoconical guide surface 23. The lower end of the body portion 21 has a diameter greater than the diameter of the legs 22 so as to define a shoulder 24 adapted to rest on the upper surface of the playfield board 10. The body portion 21 has a cylindrical bore 25 extending longitudinally axially therethrough and communicating at its lower end with the space between the legs 22. Extending laterally outwardly from each of the legs 22 are two longitudinally spaced-apart arcuate ribs or teeth 26, the lower surface of the bottom one of the teeth 26 being continuous with the guide surface 23.

To mount the post 20 on the playfield board 10, the legs 22 are pushed downwardly into the opening 10*a*. More particularly, the guide surfaces 23 guide the legs 22 into the opening 10*a* and cooperate with the wall thereof to provide a camming action which urges the legs 22 toward one another until the effective diameter thereof is less than the corresponding diameter of the opening 10*a*. The post 20 is pushed down until the shoulder 24 lies against the top surface of the playfield board 10, the length of the legs 22 preferably being such that they do not extend beneath the bottom surface of the playfield board 10, as can best be seen in FIG. 4.

In order to hold the post 20 in place on the board 10, the post assembly 12 is provided with a plug 30 having an elongated cylindrical shank 31 provided with an enlarged-diameter tip 32 at one end thereof, the tip 32 having a central cylindrical portion 33 connected to the shank 31 by a tapered portion 34 and being provided at the distal end thereof with a tapered portion 35. Thin laterally-extending tabs 35*a* extend across the distal end of the tip 32. The shank 31 is provided at its other end with an enlarged-diameter cylindrical portion 36 having a diameter substantially equal to that of the central portion 33 of the tip 32. The upper end of the plug 30 has a diameter which is greater than that of the cylindrical portion 36 so as to define an annular shoulder 37. Extending upwardly from the top of the plug 30 coaxially therewith is a reduced-diameter lug 38 provided with a laterally outwardly extending annular rib or tooth 39 thereon.

Figure 3:
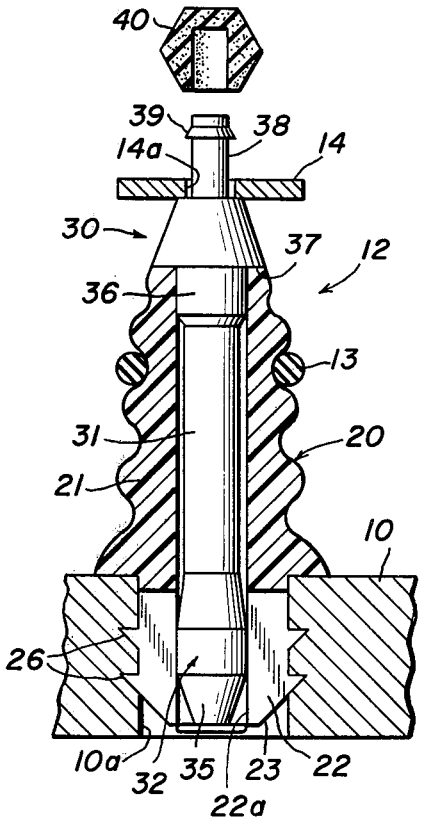
FIG. 3 is a view in vertical section taken along the line 3—3 of FIG. 2, but with the cap nut detached.
Figure 4:
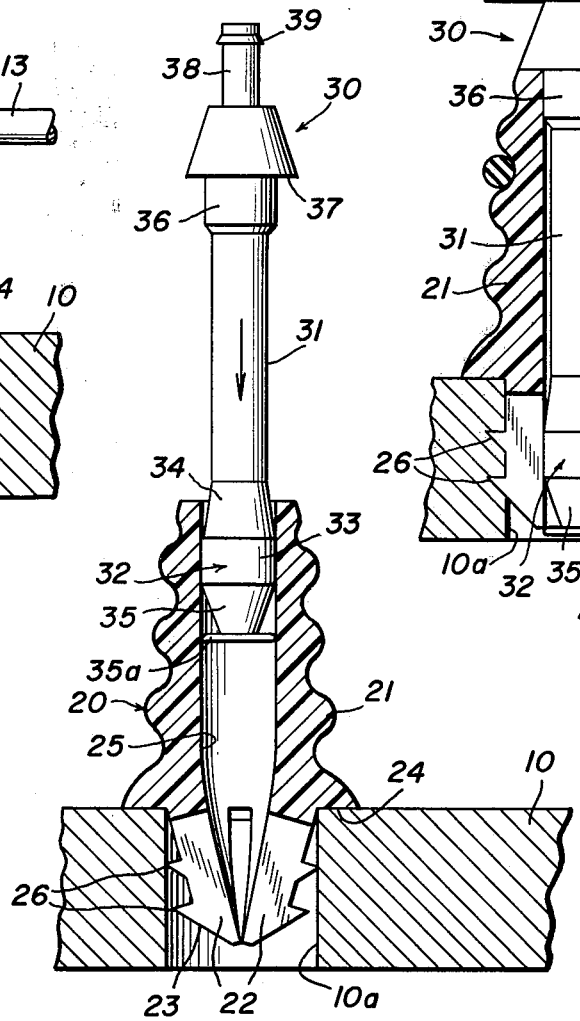
FIG. 4 is a view of the post assembly in vertical section with the post legs inserted in the playfield board opening and illustrating the manner of insertion of the plug into the post bore.
Figure 5:
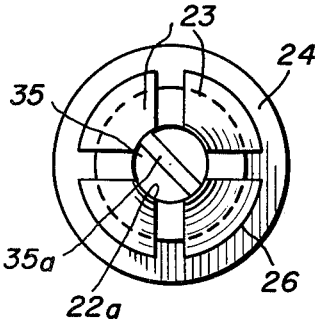
FIG. 5 is a bottom plan view of the post with the plug inserted therein.

In use, the tip 32 of the plug 30 is inserted into the upper end of the bore 25 in the post 20 and is driven downwardly therethrough into the space between the legs 22, thereby forcing the legs 22 outwardly and embedding the teeth 26 into the wall of the opening 10*a* of the board 10, until the plug 30 has reached a mounting position, illustrated in FIG. 3, wherein the shoulder 37 engages the upper end of the post body portion 21. If necessary, a hammer may be used to drive the plug 30 between the legs 22.

It will be noted that the diameter of the enlarged cylindrical portions 33 and 36 of the plug 30 is only very slightly less than the inner diameter of the bore 25 so as to be slidably engageable with the wall of the bore 25. Thus, when the plug 30 is disposed in its mounting position, the engagement of the enlarged cylindrical portion 36 with the post body portion 21 firmly positions the plug 30 without wobbling in the bore 25. Preferably, the plug 30 is positioned in the bore 25 so that the tabs 35*a* are directly opposite two of the legs 22 (see FIG. 5) and extend slightly therebelow (see FIGS. 2 and 3). Thus, when the post 20 is struck by a pinball, engagement of the tabs 35*a* with the bottoms of the legs 22 will tend to inhibit accidental dislodgment of the plug 30 from the bore 25.

After the post assemblies 12 are mounted, the rubber band 13 is positioned so as to seat in a groove in each of the posts 20. Then the cover plate 14 is dropped into position, with the lugs 38 being respectively received through the holes 14*a* in the cover plate 14. A cap nut 40 is then pushed down over each of the lugs 38, engaging with the annular tooth 39 securely to hold the cap nut 40 in place.

What has been described, therefore, is an improved post assembly for a pinball game which can be mounted on the playfield board without the use of tools, and entirely from above the playfield board, access to the underside of the board being unnecessary. There has further been provided a post assembly which affords secure attachment of the cover plate to the posts.

What is claimed is:

1. A post assembly for use in a pinball game having a playfield board for supporting a rolling pinball, the post assembly being adapted to support a cover plate having at least one hole therein and to be attached thereto with a fastener, the playfield board having at least one opening therein defined by a wall, the assembly comprising a post which includes an elongated body portion and a plurality of legs on one end of said body portion, said body portion having a longitudinal axis and having a substantially cylindrical bore extending axially therethrough and of substantially uniform transverse cross section along the entire length thereof, said legs extending generally parallel to the longitudinal axis and being movable toward said axis to enable insertion into the opening of the playfield board, and a plug having a relatively long cylindrical shank and an enlarged tip at one end of said shank and a lug at the other end of said shank, said enlarged tip being dimensioned to be received through said bore to a mounting position in engagement with said legs for forcing said legs outwardly into engagement with the wall of the opening, each of said legs having projections extending laterally outwardly therefrom and adapted to be embedded in the wall of the opening when said legs are forced outwardly by movement of said plug to the mounting position thereof, said lug extending beyond the other end of said post generally parallel to said longitudinal axis when said enlarged tip is in the mounting position thereof and having a diameter to enable insertion through the hole in the cover plate.

2. The post assembly of claim 1, wherein said legs have a length less than the thickness of the associated playfield board.

3. The post assembly of claim 1, wherein said enlarged tip has a tapered distal end portion to facilitate removable insertion into the bore and between said legs.

4. The post assembly of claim 1, wherein said plug includes a laterally outwardly extending stop member at the other end of said shank for engagement with the upper end of said post to limit the depth of insertion of said plug into the bore.

5. The post assembly of claim 1, wherein said lug has a laterally-extending flange thereon for engagement with the associated fastener.

6. The post assembly of claim 1, wherein said post is integral with said legs in a one-piece construction.

7. The post assembly of claim 1, wherein said enlarged tip includes laterally-extending tabs at the distal end thereof disposed for engagement with the lower ends of said legs when said tip is in the mounting position thereof to inhibit accidental dislodgment of said plug from said bore.

8. A post assembly for use in a pinball game having a playfield board for supporting a rolling pinball, the post assembly being adapted to support a cover plate having at least one hole therein and to be attached thereto with a fastener, the playfield board having at least one opening therein defined by a wall, the assembly comprising a post which includes an elongated body portion and a plurality of legs on one end of said body portion, said body portion having a longitudinal axis and having a substantially cylindrical bore extending axially therethrough, said legs extending generally parallel to the longitudinal axis and being movable toward said axis to enable insertion into the opening of the playfield board, and a plug having a relatively long cylindrical shank and an enlarged tip at one end of said shank and a lug at the other end of said shank, said enlarged tip being dimensioned to be received through said bore to a mounting position in engagement with said legs for forcing said legs outwardly into engagement with the wall of the opening, said lug extending beyond the other end of said post generally parallel to said longitudinal axis when said enlarged tip is in the mounting position thereof and having a diameter to enable insertion through the hole in the cover plate, said plug having an enlarged cylindrical portion near the other end of said shank and positioned to be disposed within the upper end of the bore when said enlarged tip is disposed in the mounting position thereof, the diameter of said enlarged cylindrical portion being very slightly less than that of the bore for engagement with said body portion substantially to prevent wobbling of said plug in the bore.

* * * * *